United States Patent [19]

Greene

[11] Patent Number: 4,668,847

[45] Date of Patent: May 26, 1987

[54] TWO-POSITION SWITCH

[75] Inventor: Sanford Greene, Hollywood, Fla.

[73] Assignee: Micro Pneumatic Logi, Inc., Fort Lauderdale, Fla.

[21] Appl. No.: 841,621

[22] Filed: Mar. 20, 1986

[51] Int. Cl.[4] ..... H01R 13/70

[52] U.S. Cl. ..... 200/82 R; 200/81 H; 200/153 J; 200/153 T

[58] Field of Search ..... 200/153 J, 153 T, 153 LA, 200/153 LB, 82 R, 81 H, 83 R, 83 Z, 291, 321-325

[56] References Cited

U.S. PATENT DOCUMENTS

| | | | |
|---|---|---|---|
| 1,354,999 | 10/1920 | Pieri | 200/81 H |
| 3,772,490 | 11/1973 | Thordarson | 200/81 H |
| 4,012,606 | 3/1977 | Hutt | 200/18 |
| 4,150,264 | 4/1979 | Lieberman | 200/81 H |
| 4,181,838 | 1/1980 | Neuser | 200/153 LA |
| 4,354,074 | 10/1982 | Aurand et al. | 200/153 J |
| 4,389,551 | 6/1983 | Deibele | 200/153 LA |

*Primary Examiner*—G. P. Tolin
*Attorney, Agent, or Firm*—Lewis H. Eslinger

[57] ABSTRACT

A relative translation of a first cam with respect to an electrical switch is established between first and second relative positions, whereby the electrical switch is established in a selected one of first and second states. A second cam has first and second detent positions respectively corresponding to the first and second relative positions. A pivot pivotally mounts the second cam, and a pneumatic impulse is generated for establishing the relative translation of the first cam with respect to the electrical switch. A fixed cam follower engages the second cam, whereby, in response to the impulses, the relative translation is established, a relative movement is established between the second cam and the fixed cam follower, the second cam effects a pivotal movement about the pivot, and the second cam is detained by the cam follower in one of the detent positions. Thus successive ones of the impulses control movement of the electrical switch alternately between the first and second states.

10 Claims, 7 Drawing Figures

TWO-POSITION SWITCH

BACKGROUND OF THE INVENTION

1. Field of the Invention

This invention relates to remote control apparatus and, more particularly, to novel and highly effective apparatus for remotely controlling the operation of electrical switch means movable between first and second states or conditions.

2. Description of the Prior Art

Electrical switches are movable between a plurality of states or conditions, such as "on" and "off", and often need to be controlled from a remote location. For example, it is hazardous for workers, swimmers or bathers, while in the water or standing on a wet surface, to touch an electrical switch directly in order to control lighting, audio equipment, electrical pumps and other machinery, etc., powered by house current. Persons in such an environment are electrically well grounded, and unless proper precautions are taken, electrocution may result.

One solution that has been proposed in order to enable a worker at an electroplating station or in a culvert or ship bilge or to enable a user of a hot tub or similar facility to control electrical equipment while in the water is to remove the electrical equipment from the vicinity of the water and to establish a pneumatic control link between the worker or user of the facility and the electrical equipment. Since the push button, squeeze bulb or other control device accessible to the worker or user of the facility is not electrical, it can be safely operated by a person in the water.

Conventional devices of this kind have, however, a limited operating range because of the rather large pneumatic impulse required for their operation. In other words, the conventional devices are "stiff" and not easily operated, and the push button or squeeze bulb must be pushed or squeezed vigorously in order to operate the conventional devices, even when they involve only a short pneumatic line between the push button or squeeze bulb and the remote device that operates the electrical switch. In the case where a long pneumatic line is used, operation becomes unreliable or impossible because of attenuation of the pneumatic impulse.

Squeeze bulbs and other non-electrical actuators, alternate action switches, and various linkages between the two are well known in the art. A U.S. Pat. No. 1,354,999 to Pieri discloses a pneumatic bulb which when squeezed causes simultaneous operation of a camera shutter and explosion of a charge of flash powder. Specifically, a pulse of air generated by squeezing a bulb extends an actuater pin, thus raising a plunger against the restoring force of a spring and closing a switch. An electric circuit including a battery, a coil and connecting wires then generates a spark that ignites a powder charge.

A U.S. Pat. No. 4,012,606 to Hutt discloses a switch that comprises plates that are linearly reciprocated by rotary cams under the control of a cam operator and that governs the operation of switches. The plates can be contoured to control the switches in accordance with various programs.

A U.S. Pat. No. 4,150,264 to Lieberman discloses a squeeze bulb that connects through tubing with a piston. When the bulb is squeezed, a pulse of air advances the piston against the force of a restoring spring. A piston rod engages a cam wheel on which a square cam is mounted. The square cam alternately moves a switch spring arm and contact point between closed and open positions.

A U.S. Pat. No. 4,354,074 to Aurand et al. discloses an alternate action key for use on the keyboard of a computer terminal or the like wherein a cam follower on a rotatable, resilient, C-shaped collar tracks in a cam track.

In addition, commercial pneumatic-electric devices are available wherein a pneumatic impulse deforms a diaphragm which then closes an electrical switch. In other commercial devices, a fixed cam controls the movement of a cam follower which is biased against the cam. The biasing force gives rise to friction which reduces the sensitivity of the device.

None of these patents and devices provides a solution to the problem of reliably and easily controlling the operation of electrical equipment from a remote location wherein a user of the equipment is protected against the danger of electrical shock.

OBJECTS AND SUMMARY OF THE INVENTION

An object of the invention is to remedy the deficiencies of conventional apparatus noted above and, in particular, to provide apparatus including non-electrical impulse means for reliably controlling the operation of electrical switch means from a location that can be more remote than locations conventionally chosen for operating apparatus of this type.

Another object of the invention is to provide pneumatic-mechanical apparatus that controls the operation of an alternate action switch by generating an air pulse which can be of lower magnitude than is required in conventional apparatus of this type.

Other objects of the invention are to enable greater separation between a worker standing in water or on a wet surface and electrical apparatus to be controlled by the worker, or between a user of a hot tub or similar facility and electrical apparatus to be controlled by the user, thereby providing greater safety for the worker or user and greater design flexibility; and to provide remote control apparatus for use in a work station, hot tub or similar facility that is more easily operated and more reliable than conventional apparatus of this type.

In accordance with one aspect of the invention, apparatus is provided for remotely controlling the operation of electrical switch means movable between first and second states, the apparatus comprising: first cam means for controlling movement of the electrical switch means between the first and second states; means for establishing a relative translation of the first cam means and the electrical switch means between first and second relative positions, whereby the electrical switch means is established in a selected one of the first and second states; second cam means having first and second detent positions respectively corresponding to the first and second relative positions; pivot means pivotally mounting the second cam means; non-electrical impulse means for generating impulses for establishing the relative translation of the first cam means and the electrical switch means; and fixed cam follower means engaging the second cam means, whereby, in response to the impulses, the relative translation is established, a relative movement is established between the second cam means and the fixed cam follower means, the second cam means effects a pivotal movement about the pivot means, and the second cam means is detained by the cam follower means in one of the detent positions; whereby successive ones of the impulses control movement of the electrical switch means between the first and second states.

BRIEF DESCRIPTION OF THE DRAWINGS

A better understanding of the objects, features and advantages of the invention can be gained from the following detailed description of the preferred embodiment thereof, in conjunction with the appended figures of the drawing, wherein.

DESCRIPTION OF THE PERFERRED EMBODIMENT

Figure 1:
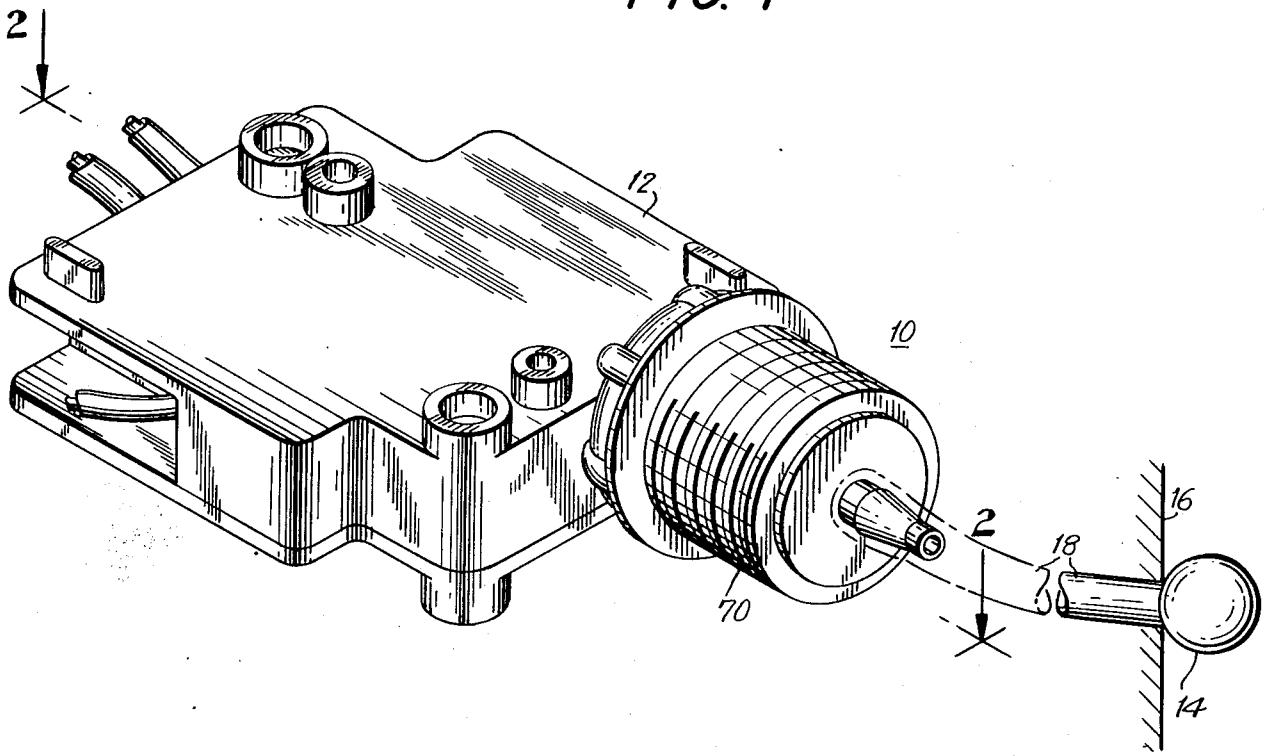
FIG. 1 is a perspective view of a preferred embodiment of apparatus constructed in accordance with the invention.

FIG. 1 shows apparatus 10 constructed in accordance with the invention. It comprises a housing 12 for housing an electrical switch described below and further comprises a squeeze bulb 14 (not drawn to scale), push button, etc., located remotely with respect to the electrical switch. For simplicity, the control device at the remote location is represented as a squeeze bulb 14 connected to a support represented schematically at 16. The support 16 may be an independent structure at a work station or may be attached to or constitute an integral part of a hot tub, swimming pool, or similar facility. Tubing 18, which may be many meters in length, connects the squeeze bulb 14 to the housing 12. The representation of the tubing 18 includes a break, indicating that the tubing may have a length greater than illustrated; the tubing 18 may in fact have a length greater than is possible in conventional apparatus of this type. This affords greater separation between the electrical switch contained within the housing 12 and the user of the hot tub or similar facility and also affords greater design flexibility in the location of the housing 12 with respect to the squeeze bulb 14.

Figure 2:
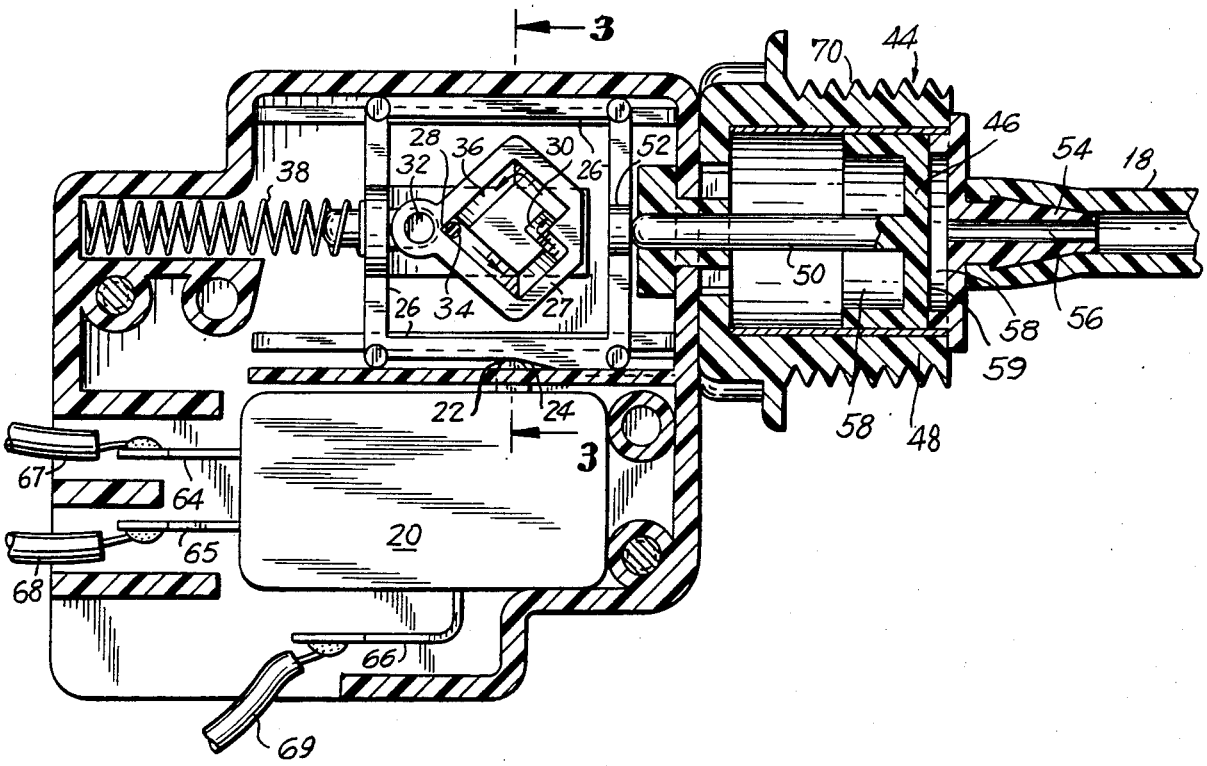
FIG. 2 is a sectional view taken substantially along the line 2—2 of FIG. 1 and looking in the direction of the arrows.
Figure 4:
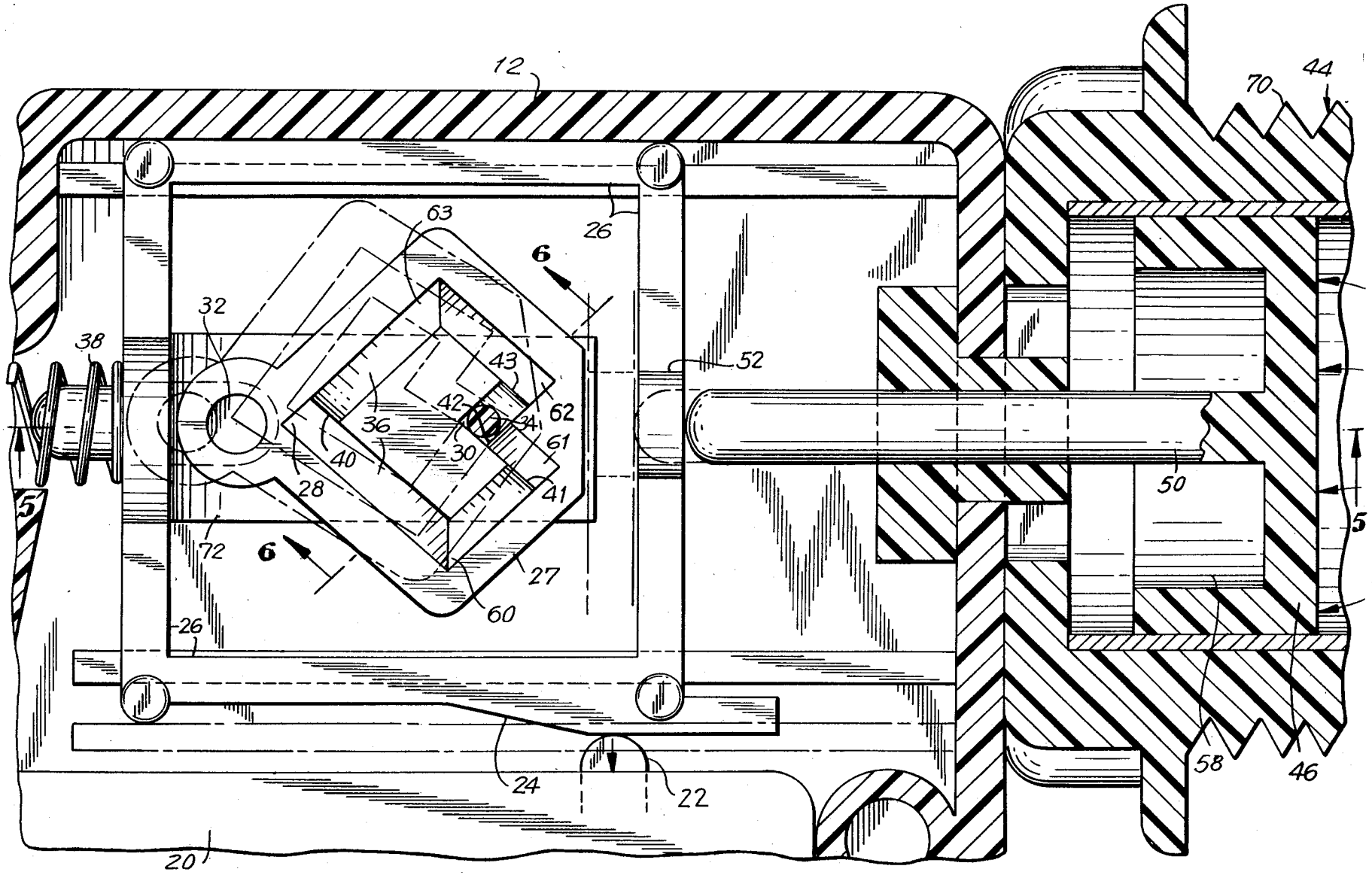
FIG. 4 is a top plan sectional view of the apparatus of FIG. 1.

FIGS. 2 and 4 show the electrical switch 20 in "black box" form. It comprises, for example, make-break contacts (not shown) that are alternately closed and opened by operation of a plunger 22, which may for example be spring-loaded. Specifically, the plunger 22 moves between an outer position illustrated in FIG. 2 and an inner position illustrated in FIG. 4. One position of the plunger 22 corresponds to one state or condition of the electrical switch, and the other position of the plunger 22 corresponds to the other state or condition of the switch.

A first cam 24 controls movement of the electrical switch 20 between the first and second states or conditions by controlling the movement of the plunger 22 between the outer and inner positions. A support 26 in the form of a generally square frame supports the first cam 24 and facilitates relative translation of the first cam 24 with respect to the electrical switch 20 between first and second relative positions respectively illustrated in FIGS. 2 and 4, whereby the electrical switch 20 is established in a selected one of the first and second states or conditions.

Figure 3:
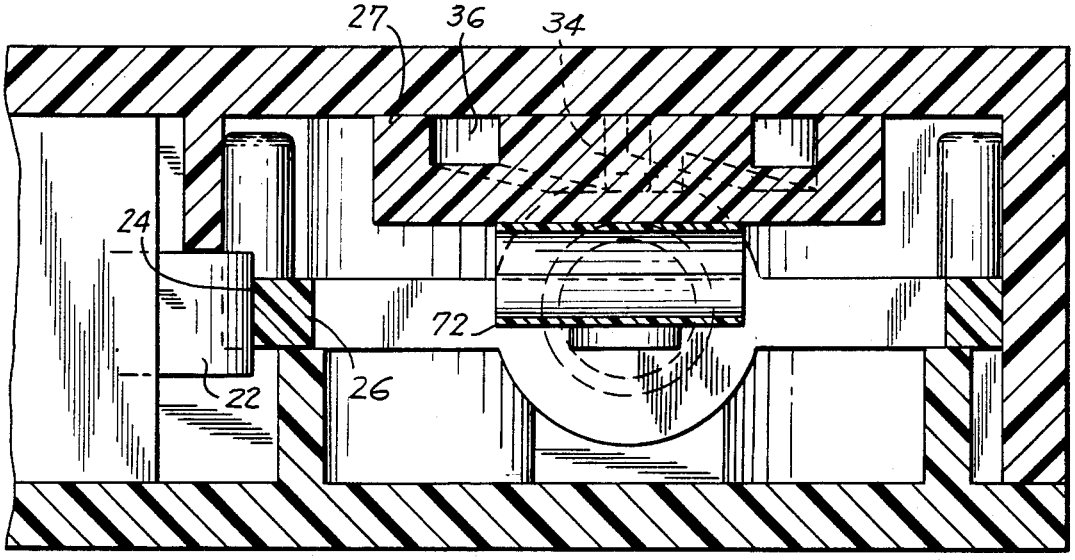
FIG. 3 is a sectional view taken substantially along the line 3—3 of FIG. 2 and looking in the direction of the arrows.
Figures 5, 6:
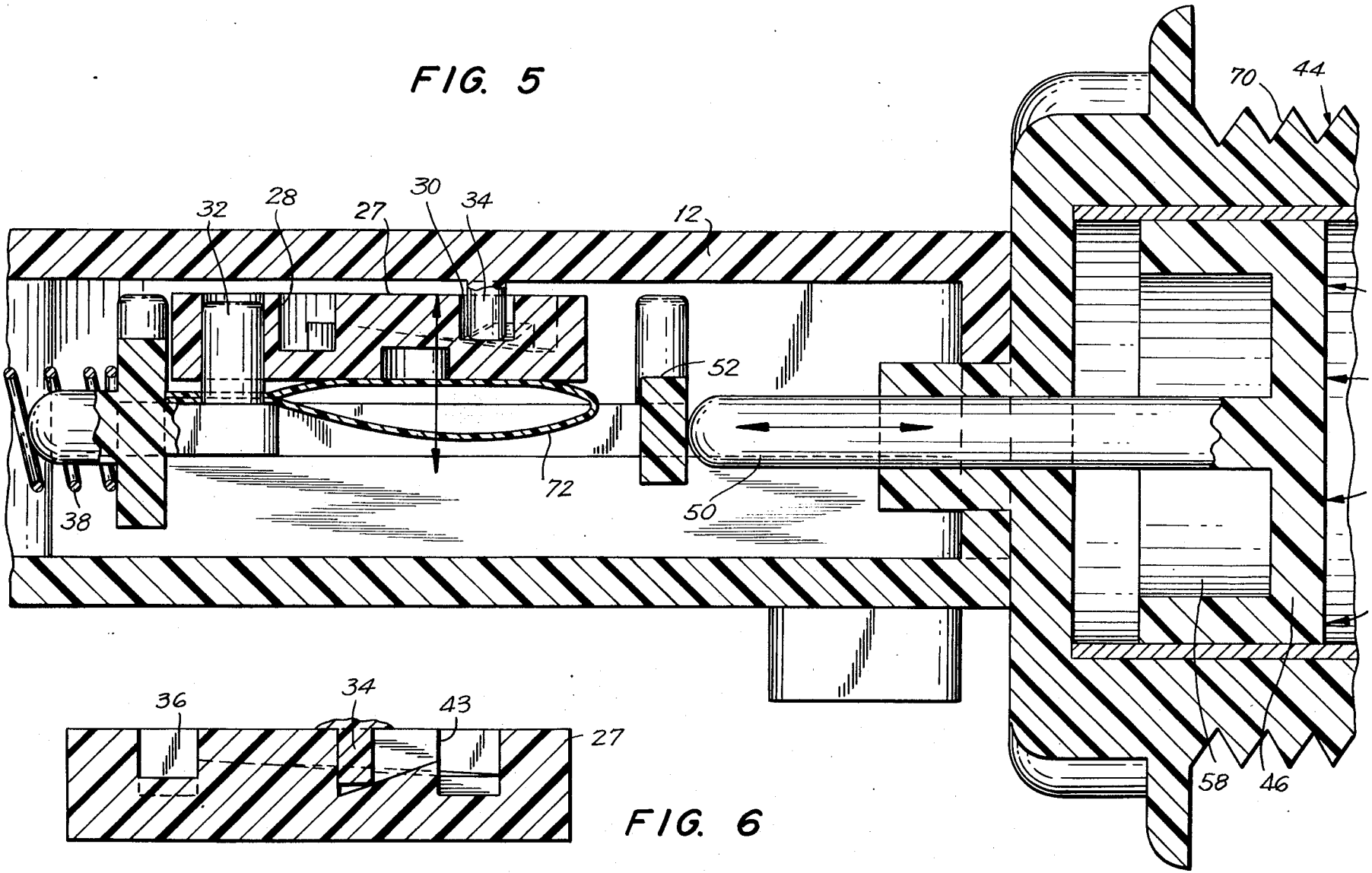
FIG. 5 is a sectional view taken substantially along the line 5—5 of FIG. 4 and looking in the direction of the arrows.
FIG. 6 is a sectional view taken substantially along the line 6—6 of FIG. 4 and looking in the direction of the arrows.

A second cam 27 is biased upwardly (FIGS. 3 and 5) by a plastic spring 72 and has first and second detent positons 28 and 30 that respectively correspond to the first and second relative positions of the first cam 24 and electrical switch 20.

A pivot 32 pivotally mounts the second cam 24, and a fixed cam follower 34 connected to the housing 12 engages the second cam 27, whereby the second cam 27 effects a pivotal movement about the pivot 32 (FIG. 4) in response to the relative translation between the first and second relative positions respectively illustrated in FIGS. 2 and 4.

As the cam 27 moves between the positions illustrated in FIGS. 2 and 4, a relative movement is established between the second cam 27 and the fixed cam follower 34, and the second cam 27 is detained by the cam follower 34 in one of the detent positions 28, 30.

A non-electrical impulse generator comprising the squeeze bulb 14, tubing 18, and other structure described below generates impulses for simultaneously establishing the relative translation of the first cam 24 and the electrical switch 20 and the pivoting of the second cam 27 as it moves between the first and second detent positions 28, 30. Thus successive ones of the pneumatic impulses control movement of the electrical switch 20 between the first and second states or conditions respectively illustrated in FIGS. 2 and 4.

The support 26 translates the first cam 24 in a direction substantially perpendicular to the direction of movement of the plunger 22 between the outer and inner positions thereof.

The second cam 27 comprises a cam track 36 describing a closed loop. The first and second detent positions 28, 30 are spaced apart along the closed loop by substantially 180°.

The cam track 36 describes a pair of V's each having a vertex adjacent to a different one of the detent positions 28, 30, both of the V's being oriented in the same direction (with their respective vertices positioned to the left and opening towards the right in FIGS. 2 and 4). Biasing means such as a compression coil spring 38 is operatively opposed to the impulse generator in that it exerts a continuous force on the support 26 directed to the right (FIGS. 2 and 4), whereas the impulses developed by the impulse generator are directed to the left in those figures. The spring 38 biases one of the V's against the cam follower 34 in the absence of an impulse from the impulse generator.

Figure 7:
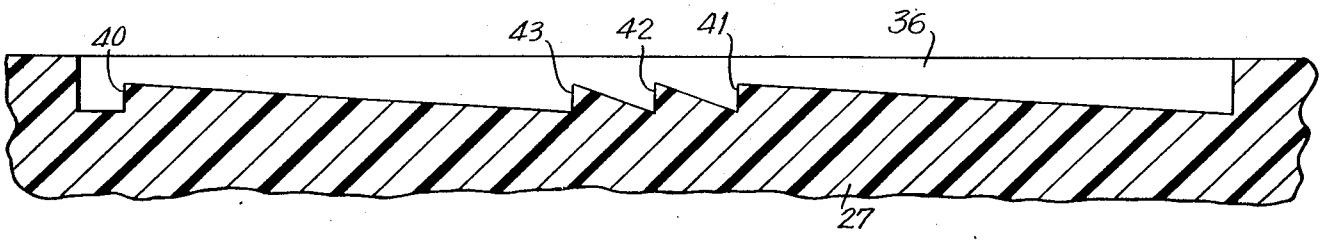
FIG. 7 is a developed schematic elevational view of a cam employed in accordance with the present invention and illustrating ratcheting steps formed therein.

The cam track 36 is formed with ratchet steps 40, 41, 42, 43 (best shown in FIGS. 4 and 7) limiting the direction of the relative movement to one of the clockwise and counterclockwise directions. From the perspective of FIGS. 2 and 4, for the orientation of the ratchet steps 40–43 illustrated, the relative movement of the fixed cam follower 34 in the cam track 36 is counterclockwise.

The impulse generator comprises, in addition to the squeeze bulb 14 and tubing 18 mentioned above, a piston-cylinder assembly 44 (FIG. 2) connected to the support 26. The assembly 44 includes a piston 46 fitting snuggly but slidably within a cylinder 48 and having a ram extension 50 that engages a rounded portion 52 of the support 26. A nipple 54 formed with a bore 56 is engaged by the tubing 18 to provide a substantially air-tight connection between the squeeze bulb 14 (FIG. 1) and the interior 58 of the cylinder 48. Consequently, when the squeeze bulb 14 is squeezed, a pulse of air is generated that exerts pressure on the right hand face 59 (FIG. 2) of the piston 46, driving the piston 46 to the left. The ram extension 50 engages the rounded portion 52 of the support 26 and moves the support 26 to the left, compressing the spring 38.

Regardless of whether the second cam 27 is detained in the first detent position 28, as illustrated in FIG. 2, or the second detent position 30, as illustrated in FIG. 4, it is moved to the other detent position in response to a new pneumatic impulse. Specifically, if the second cam 27 is detained in the first detent position 28, as illustrated in FIG. 2, meaning that the fixed cam follower 34 is in the relative position with respect to the second cam 27 illustrated in FIG. 2, movement of the support 26 to the left in FIG. 2 in response to a pneumatic impulse will cause the second cam 27 to pivot counterclockwise about the pivot 32, since the cam follower 34 is fixed with respect to the housing 12 and moreover cannot climb the ratchet step 40 (FIGS. 4 and 7) but can only track counterclockwise in the cam track 36.

The counterclockwise pivoting of the second cam 27 continues until the fixed cam follower 34 reaches the bend 60 (FIG. 4) in the cam track 36. Continued movement of the support 26 to the left in FIGS. 2 and 4 then causes the second cam 27 to pivot clockwise as the fixed cam follower 34 continues to track along the cam track 36. The cam follower 34 ultimately executes a relative "jump" off the step 41 and arrives at the bend 61. Since the cam follower 34 is fixed with respect to the housing 12, it is actually the cam 27 that moves (upward in FIG. 3) during the jump. The plastic spring 72 maintains the cam 27 in contact with the cam follower 34.

With the cam follower 34 wedged in the bend 61, the support 26 can move no farther to the left. As the pneumatic impulse subsides, the spring 38 then forces the support 26 to the right (FIGS. 2 and 4), so that the fixed cam follower 34 causes the second cam 27 to continue to rotate clockwise as the cam follower 34 tracks counterclockwise in the cam track 36. The cam follower 34 then jumps off the step 42 and is held by the spring 38 in the apex of the V defining the second detent position 30. It will remain in this position until activated by another pneumatic impulse. The plastic spring 72 continues to maintain the cam 27 in contact with the cam follower 34.

When another pneumatic impulse is generated, the cam follower 34 being detained in the second detent position 30 (FIG. 4), the support 26 is moved to the left (FIGS. 2 and 4). The fixed can follower 34 tracks counterclockwise in the cam track 36, since it cannot climb the step 42. The second cam 27 therefore pivots clockwise about the pivot 32, and the cam follower 34 jumps off the step 43 and becomes wedged in the bend 62 until the impulse subsides. When the impulse subsides, the spring 38 moves the support 26 to the right (FIGS. 2 and 4), so that the second cam 27 pivots clockwise about the pivot 32 until the fixed cam follower 34, still tracking counterclockwise in the cam track 36, reaches the bend 63. Continued movement of the support 26 to the right causes the second cam 27 to pivot conterclockwise as the fixed cam follower 24 continues to track counterclockwise in the cam track 36. The cam follower 34 ultimately jumps off the step 40 and is detained in the first detent position 28. It will remain in this position until another actuation of the impulse generator, whereupon it moves to the second detent position 38 in the manner described above.

Thus successive impulses from the impulse generator comprising the squeeze bulb 44, tubing 18 and piston-cylinder assembly 44 cycle the apparatus back and forth between the first and second detent positions 28, 30, cycle the plunger 22 back and forth between outer and inner positions, and consequently cycle the switch 20 back and forth between two states or conditions (for example, "on" and "off").

Electrical terminals 64, 65, 66 are provided for connection to electrical leads 67, 68, 69, respectively, which are connected to the electrical apparatus (not shown) to be controlled.

Threads 70 (FIGS. 1 and 2) provide for connection of the housing 12 to a suitable support (not shown).

Thus there is provided in accordance with the invention apparatus including non-electrical impulse means for reliably controlling the operation of an electrical switch from a location that can be more remote than locations conventionally chosen for operating apparatus of this type. There is no biasing force on the second cam 27 acting in either the clockwise or counterclockwise direction about the pivot 32; the second cam 27 thus pivots easily and in response to a light pneumatic impulse. This makes the device very sensitive and enables the use of an exceptionally long piece of tubing 18, thus ensuring that the electrical equipment is safely away from the worker or user of the hot tub or similar facilty and affording maximum freedom of choice to the designer of the installation.

Many modifications of the preferred embodiment of the invention disclosed above will readily occur to those skilled in the art upon consideration of this disclosure. For example, while the means for generating the pneumatic impulse is shown as including a squeeze bulb 14, a push button comprising a piston-cylinder assembly can be substituted. Moreover, while the second cam 27 is disclosed as being translated with the first cam 24, it is possible to translate the plunger 22 and switch 20 with the second cam 27 and to make the first cam 24 stationary. Accordingly, the invention is not limited except by the appended claims.

What is claimed is:

1. Apparatus for remotely controlling the operation of electrical switch means movable between first and second states, said apparatus comprising:

first cam means for controlling movement of said electrical switch means between said first and second states;

means for establishing a relative translation of said first cam means and said electrical switch means between first and second relative positions, whereby said electrical switch means is established in a selected one of said first and second states;

second cam means having first and second detent positions respectively corresponding to said first and second relative positions;

pivot means pivotally mounting said second cam means;

non-electrical impulse means for generating impulses for establishing said relative translation of said first cam means and said electrical switch means; and fixed cam follower means engaging said second cam means, whereby, in response to said impulses, said relative translation is established, a relative movement is established between said second cam means and said fixed cam follower means, said second cam means effects a pivotal movement about said pivot means, and said second cam means is detained by said cam follower means in one of said detent positions;

whereby successive ones of said impulses control movement of said electrical switch means between said first and second states.

2. Apparatus according to claim 1 wherein said electrical switch means comprises a plunger movable between an outer position and an inner position and said first cam means controls movement of said plunger between said outer and inner positions.

3. Apparatus according to claim 2 wherein said translation means translates said first cam means in a direction substantially perpendicular to the direction of movement of said plunger between said outer and inner positions.

4. Apparatus according to claim 1 wherein said second cam means comprises a cam track describing a closed loop.

5. Apparatus according to claim 4 wherein said first and second detent positions are spaced apart along said closed loop by substantially 180°.

6. Apparatus according to claim 4 wherein said track describes a pair of V's each having a vertex adjacent to a different one of said detent positions, both of said V's being oriented in the same direction, and further comprising biasing means operatively opposed to said impulse means, whereby the vertex of a selected one of said V's is biased against said cam follower means in the absence of an impulse from said impulse means.

7. Apparatus according to claim 4 wherein said track is formed with ratchet steps limiting the direction of said relative movement to one of the clockwise and counterclockwise directions.

8. Apparatus according to claim 1 wherein said impulse means comprises a piston-cylinder assembly connected to said support means.

9. Apparatus according to claim 8 wherein said piston-cylinder assembly is pneumatic.

10. Apparatus according to claim 1 further comprising second biasing means urging said second cam means against said cam follower means.

* * * * *